US008550849B2

(12) United States Patent
Yamaji

(10) Patent No.: US 8,550,849 B2
(45) Date of Patent: Oct. 8, 2013

(54) CONNECTOR AND CONNECTING OBJECT

(75) Inventor: Takahiro Yamaji, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 41 days.

(21) Appl. No.: 13/432,879

(22) Filed: Mar. 28, 2012

(65) Prior Publication Data

US 2012/0252252 A1 Oct. 4, 2012

(30) Foreign Application Priority Data

Mar. 29, 2011 (JP) ..... 2011-072910

(51) Int. Cl.
*H01R 13/648* (2006.01)

(52) U.S. Cl.
USPC ..... 439/607.41; 439/495

(58) Field of Classification Search
USPC ..... 439/372, 492, 495, 497, 527, 607.35, 439/607.4, 607.41, 607.49, 660
See application file for complete search history.

(56) References Cited

U.S. PATENT DOCUMENTS

| | | | | |
|---|---|---|---|---|
| 6,203,346 | B1 * | 3/2001 | Wu et al. | 439/260 |
| 6,293,818 | B1 | 9/2001 | Kim et al. | |
| 7,465,186 | B2 * | 12/2008 | Yotsutani | 439/497 |
| 7,722,387 | B2 * | 5/2010 | Yamaji et al. | 439/497 |
| 7,927,122 | B2 | 4/2011 | Yamaji et al. | |
| 7,934,957 | B1 * | 5/2011 | Nakajima et al. | 439/607.49 |
| 7,993,151 | B2 * | 8/2011 | Chuo et al. | 439/260 |
| 8,083,542 | B2 * | 12/2011 | Kodaira | 439/497 |
| 8,221,147 | B2 * | 7/2012 | Ozeki | 439/260 |
| 8,241,065 | B2 * | 8/2012 | Ikari et al. | 439/607.41 |
| 8,241,069 | B2 * | 8/2012 | Yamaji | 439/660 |
| 8,298,001 | B2 * | 10/2012 | Ashibu et al. | 439/495 |
| 8,388,370 | B2 * | 3/2013 | Yamaji et al. | 439/497 |

FOREIGN PATENT DOCUMENTS

| | | |
|---|---|---|
| JP | 2000-195595 A | 7/2000 |
| JP | 2011-018488 A | 1/2011 |

OTHER PUBLICATIONS

Korean Offrice Action dated Mar. 26, 2013 (and English translation thereof) in counterpart Korean Application No. 10-2012-0029132.

* cited by examiner

*Primary Examiner* — Thanh Tam Le
(74) *Attorney, Agent, or Firm* — Holtz, Holtz, Goodman & Chick, PC

(57) ABSTRACT

A connector is configured to be mated with and connected to a mating connector in a state where the connector is attached to an FPC having a principal surface on which a signal terminal and a ground terminal are arranged. The connector comprises a housing, a plurality of contacts held by the housing, a cover shell partially covering the housing and a lock bar supported by the housing and/or the cover shell so as to be turnable. Each of the contacts has an exposed portion connectable to the signal terminal of the connecting object. The cover shell has a grounded portion connectable to the ground terminal of the connecting object. The lock bar is configured to lock a mating state where the connector is mated with the mating connector.

14 Claims, 8 Drawing Sheets

CONNECTOR AND CONNECTING OBJECT

CROSS REFERENCE TO RELATED APPLICATIONS

Applicants claim priority under 35 U.S.C. §119 of Japanese Patent Application No. JP2011-72910 filed Mar. 29, 2011.

BACKGROUND OF THE INVENTION

This invention relates to a connector configured to be mated with and connected to a mating connector mounted on an object (for example, a circuit board) in a state where the connector is attached to a sheet-like connecting object such as an FPC (Flexible Printed Circuit) or an FFC (Flexible Flat Cable).

For example, a connector assembly having a reduced height is disclosed in JP-A 2011-18488, contents of which are incorporated herein by reference.

As shown in FIG. 14, the connector assembly disclosed in JP-A 2011-18488 comprises a first connector and a second connector configured to be mated with each other. The first connector is mountable on a circuit board. The second connector is attachable to a plurality of cables (i.e. a plurality of connecting objects). The first connector and the second connector of JP-A 2011-18488 are matable efficiently while they have reduced heights. More specifically, two operations, namely a positioning operation and a final mating operation, are performed so that the first connector and the second connector are mated with each other. By the positioning operation, the first connector and the second connector are relatively positioned in the vertical direction. By the final mating operation, the second connector is mated with the first connector along the horizontal direction. In detail, as shown in FIGS. 14(*a*) and 14(*b*), the second connector located above the first connector (i.e. located at the positive Z-side of the first connector) is moved downward (i.e. moved along the negative Z-direction) so that the first connector is covered by the second connector. The first connector and the second connector shown in FIG. 14(*b*) are relatively positioned to each other in the vertical direction (Z-direction). Then, as shown in FIGS. 14(*b*) and 14(*c*), the second connector is horizontally moved along the positive X-direction so as to be mated with the first connector.

It is desired to connect a sheet-like connecting object such as an FPC to a connector matable with and connectable to a mating connector (i.e. a connector similar to the second connector of JP-A 2011-18488). In other words, it is desired to connect the second connector not to a connecting object including a plurality of cables but to a sheet-like connecting object such as an FPC.

However, the second connector of JP-A 2011-18488 is not configured to be attachable to a sheet-like connecting object.

SUMMARY OF THE INVENTION

It is therefore an object of the present invention to provide a connector having proper structures so as to be attached to a sheet-like connecting object.

One aspect of the present invention provides a connector configured to be mated with and connected to a mating connector in a state where the connector is attached to a connecting object of a sheet-like shape. The connecting object has a principal surface and being provided with a signal terminal and a ground terminal arranged thereon The connector comprises a housing, a plurality of contacts, a cover shell and a lock bar. The plurality of contacts are held by the housing so as to be arranged in a pitch direction. Each of the contacts has a held portion and an exposed portion. The held portion is held by the housing. The exposed portion is arranged so as to be connectable to the signal terminal of the connecting object. The exposed portion projects from the housing in a front-to-rear direction perpendicular to the pitch direction. The exposed portion is located at a predetermined position in a first vertical direction perpendicular to the pitch direction. The cover shell covers at least a part of the housing in the first vertical direction. The cover shell has a grounded portion. The grounded portion is arranged so as to be connectable to the ground terminal of the connecting object. The grounded portion is located at the predetermined position in the first vertical direction. The lock bar is supported by the housing and/or the cover shell so as to be turnable. The lock bar is configured to lock a mating state where the connector is mated with the mating connector.

Another aspect of the present invention provides a connecting object having a sheet-like shape. The connecting object comprises two principal surfaces, a signal terminal and a ground terminal. The signal terminal and the ground terminal are exposed on one of the principal surfaces.

An appreciation of the objectives of the present invention and a more complete understanding of its structure may be had by studying the following description of the preferred embodiment and by referring to the accompanying drawings.

Figure 1:
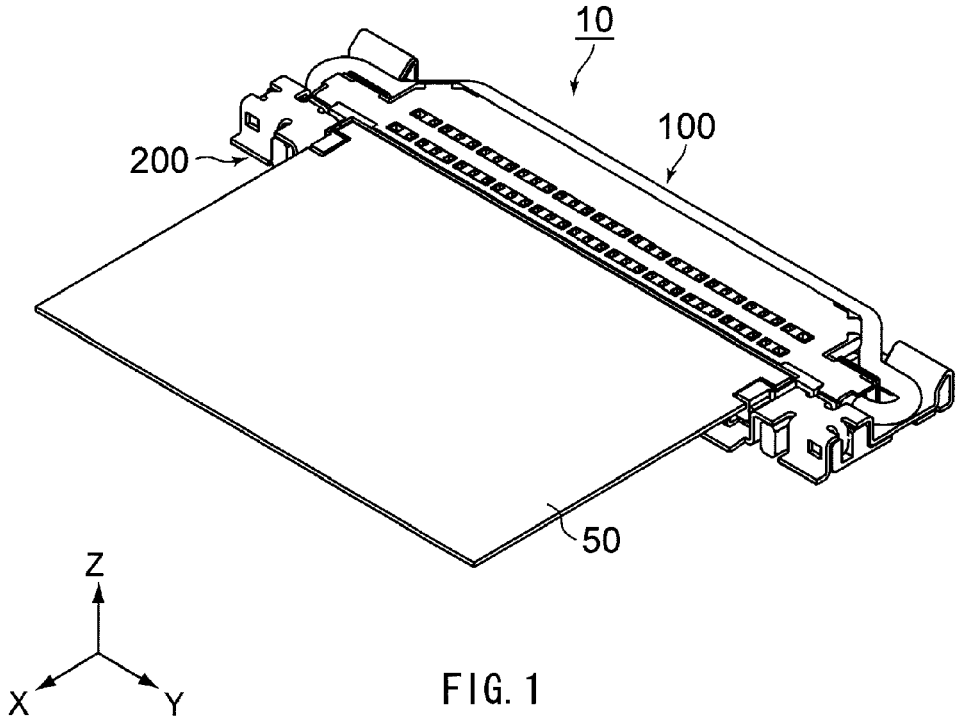
FIG. 1 is a perspective view showing a connector assembly according to an embodiment of the present invention, wherein a lock bar of the connector of the connector assembly is located at a lock position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
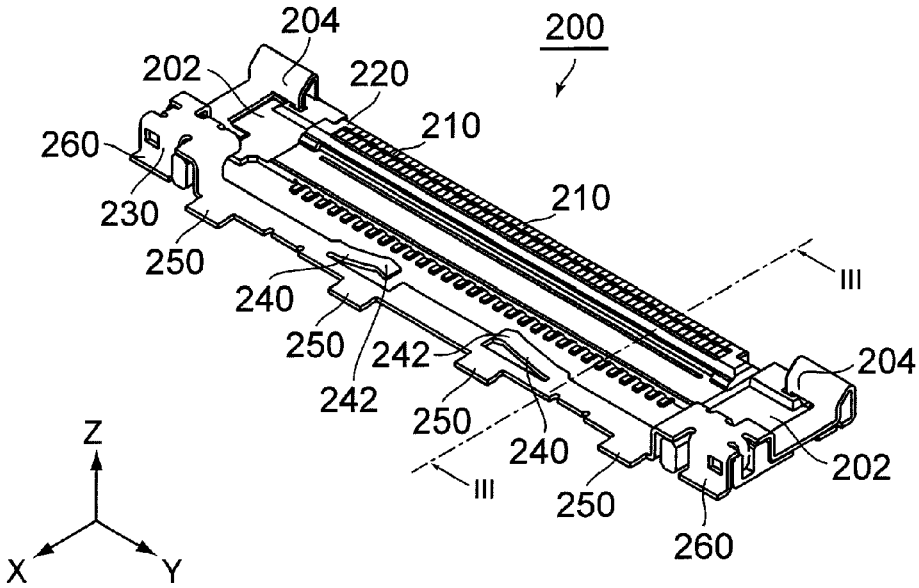
FIG. 2 is a perspective view showing a mating connector of the connector assembly of FIG. 1.
Figure 4:
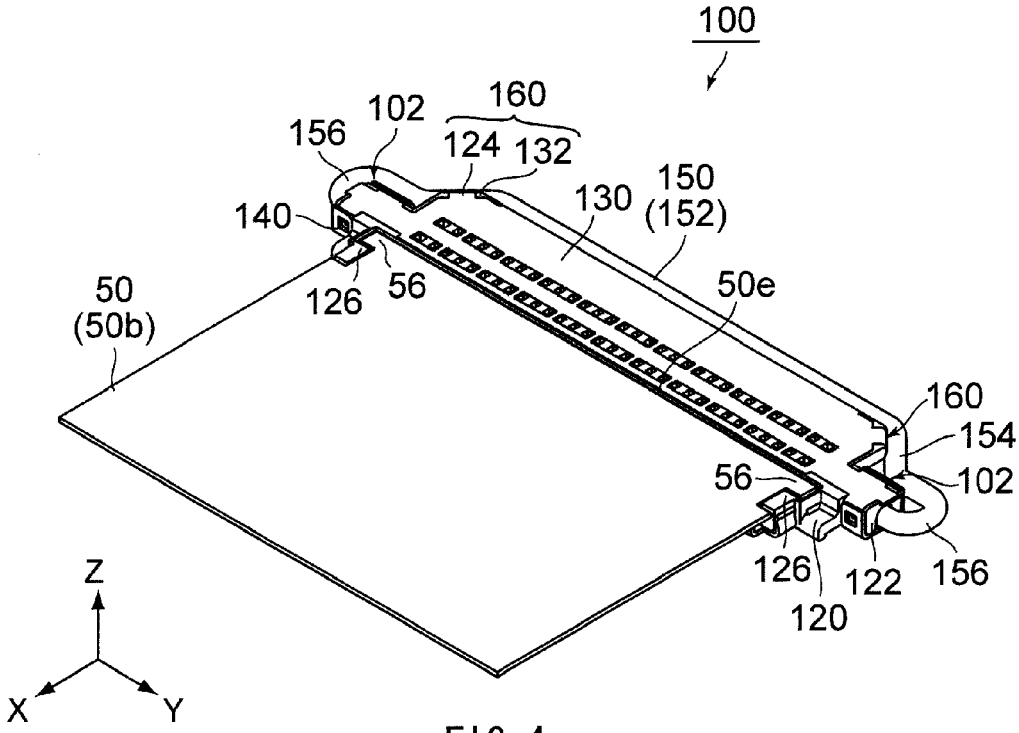
FIG. 4 is a perspective view showing the connector of the connector assembly of FIG. 1, wherein the lock bar is located at the lock position.
Figure 5:
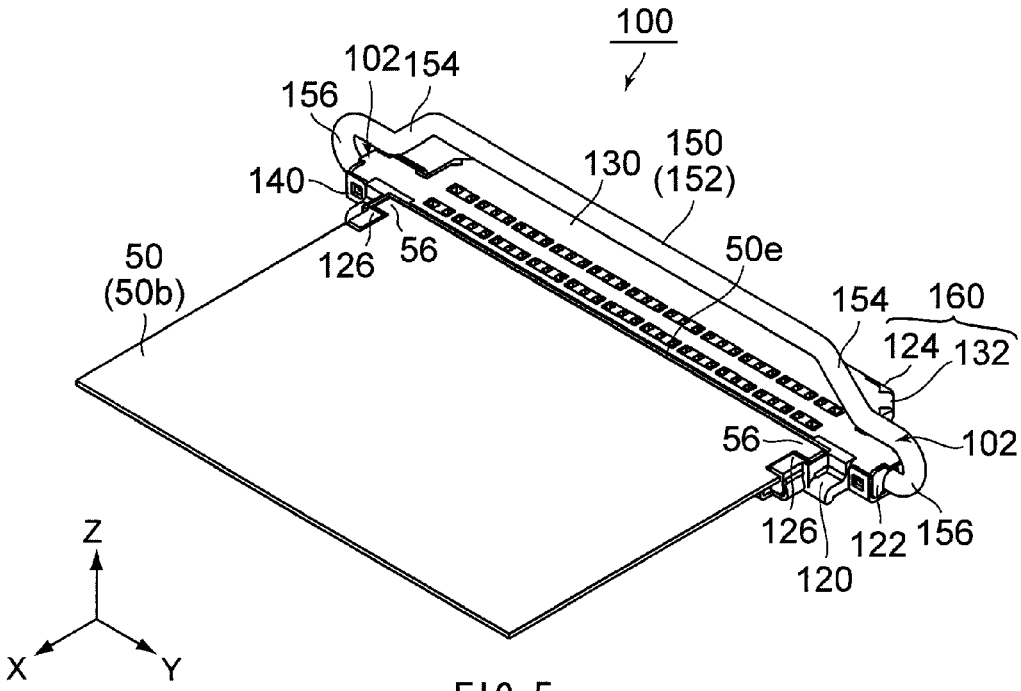
FIG. 5 is a perspective view showing the connector of FIG. 4, wherein the lock bar is located at a release position.

As shown in FIGS. 1, 2 and 4, a connector assembly 10 according to an embodiment of the present invention comprises a connector 100 and a mating connector 200. The connector 100 is configured to be attached to an FPC (connecting target) 50. The mating connector 200 is configured to be mounted on a circuit board (not shown). The connector 100 is configured to be mated with and connected to the mating connector 200 in a state where the connector 100 is attached to the FPC 50. In detail, the connector 100 located above the mating connector 200 is moved downward (i.e. moved along the negative Z-direction). The connector 100 covers the positive Z-side of the mating connector 200 so that the connector 100 and the mating connector 200 are relatively positioned in the vertical direction (Z-direction). Then, the connector 100 is moved in the front-to-rear direction (X-direction) toward the mating connector 200 so that the connector 100 is mated with and connected to the mating connector 200. As can be seen from the above description, according to the present embodiment, it is possible to reduce the height of the connector assembly 10. Moreover, it is possible to mate the connector 100 and the mating connector 200 each other more easily.

Figure 3:
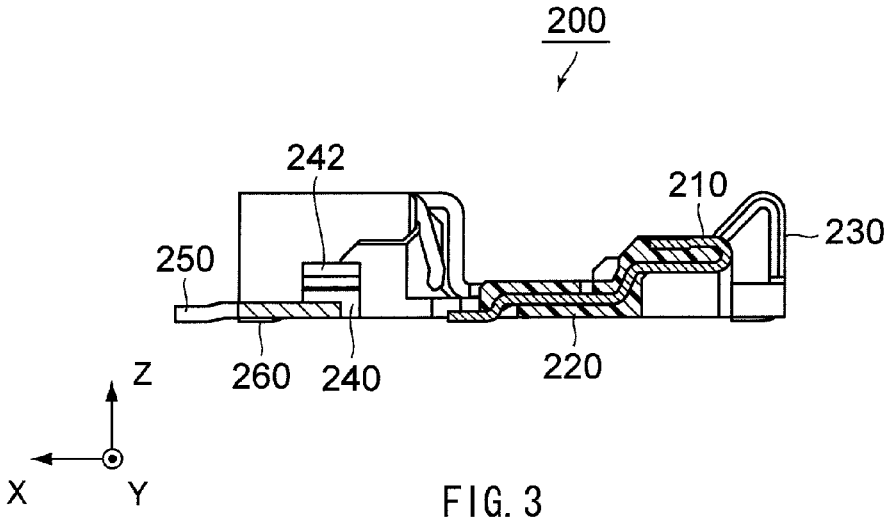
FIG. 3 is a cross-sectional view showing the mating connector of FIG. 2, taken along lines III-III.

As shown in FIGS. 2 and 3, the mating connector 200 comprises a plurality of mating contacts 210 each made of a metal, a mating housing 220 made of an insulating material and a mating shell 230 made of a metal. The mating housing 220 holds the mating contacts 210. More specifically, the mating contacts 210 are insert-molded into the mating housing 220 when the mating housing 220 is formed. The mating shell 230 partially covers the mating housing 220. The mating shell 230 is provided with two spring portions 240. Each of the spring portions 240 is formed so as to extend long in the pitch direction (Y-direction). Each of the spring portions 240 has a free end and a fixed end formed on opposite ends thereof in the pitch direction. The free end is nearer to the center of the mating shell 230 than the fixed end. In other words, the free ends of the two spring portions 240 are formed so as to face each other in the pitch direction. The spring portion 240 has a contact point 242 formed in the vicinity of the free end. The mating shell 230 has a plurality of connected-to-ground portions 250 and two hold-downs 260. In detail, the mating shell 230 according to the present embodiment has four connected-to-ground portions 250. The connected-to-ground portions 250 are formed on a bottom portion of the mating shell 230 so as to extend in the positive X-direction. The two hold-downs 260 are formed on opposite ends in the pitch direction of the mating shell 230 so as to extend along the positive X-direction. The connected-to-ground portions 250 and the hold-downs 260 are connected to a ground pattern formed on a circuit board (not shown) when the mating connector 200 is mounted on the circuit board (not shown). The mating connector 200 comprises two mating portions 202 formed on opposite ends in the pitch direction (Y-direction) thereof, respectively. Each of the mating portions 202 is formed from a part of the mating housing 220 and a part of the mating shell 230. The mating portion 202 is formed so as to be depressed in the negative Z-direction. The mating portion 202 has a negative X-side wall which functions as a pressing portion 204.

As shown in FIGS. 4 to 13, the connector 100 comprises a plurality of contacts 110 each made of a metal, a housing 120 made of an insulating material, a base shell 130 made of a metal, a cover shell 140 made of a metal and a lock bar 150 made of a metal. The contacts 110 are held by the housing 120 so as to be arranged in a pitch direction (Y-direction). The base shell 130 is insert-molded into the housing 120. The cover shell 140 covers at least a part of the housing 120 in the first vertical direction (positive Z-direction). The connector 100 comprises two mated portions 102 formed on opposite ends thereof in the pitch direction, respectively. The mated portion 102 is formed so as to project outward in the pitch direction. The mated portions 102 are configured to be mated with the respective mating portions 202 of the mating connector 200. More specifically, the mated portion 102 is mated with and accommodated in the mating portion 202 when the connector 100 and the mating connector 200 are mated with each other.

Figure 7:
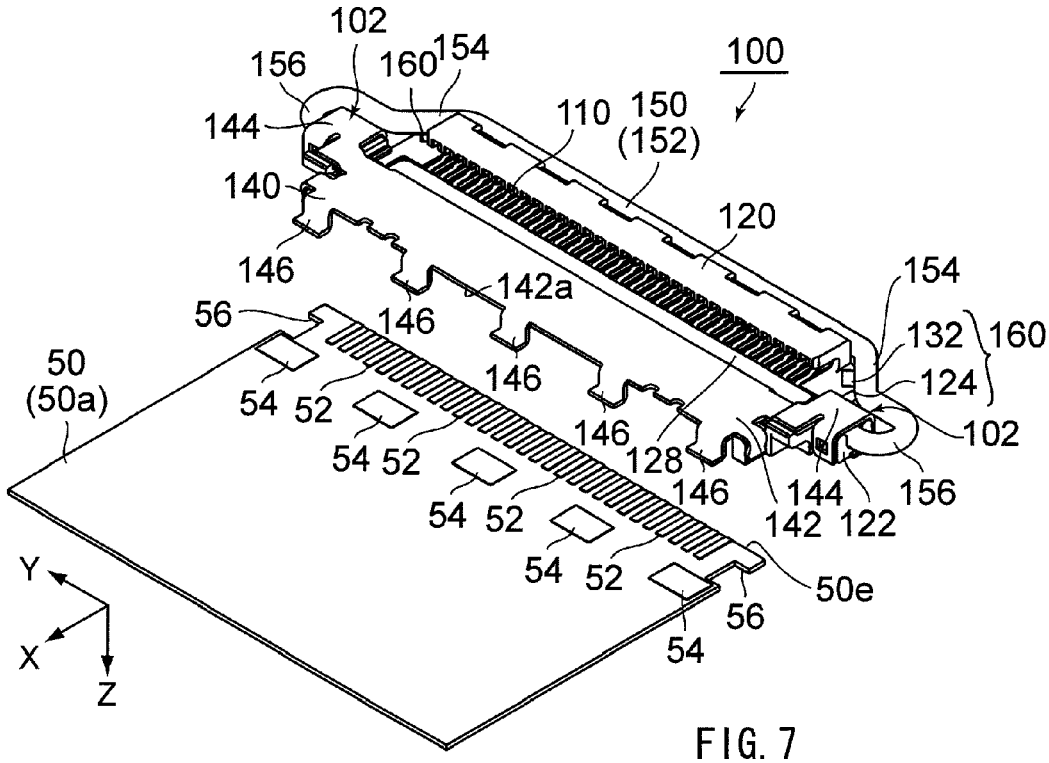
FIG. 7 is a perspective view showing a bottom side of the connector of FIG. 4, wherein the connector is not attached to the FPC.
Figure 10:
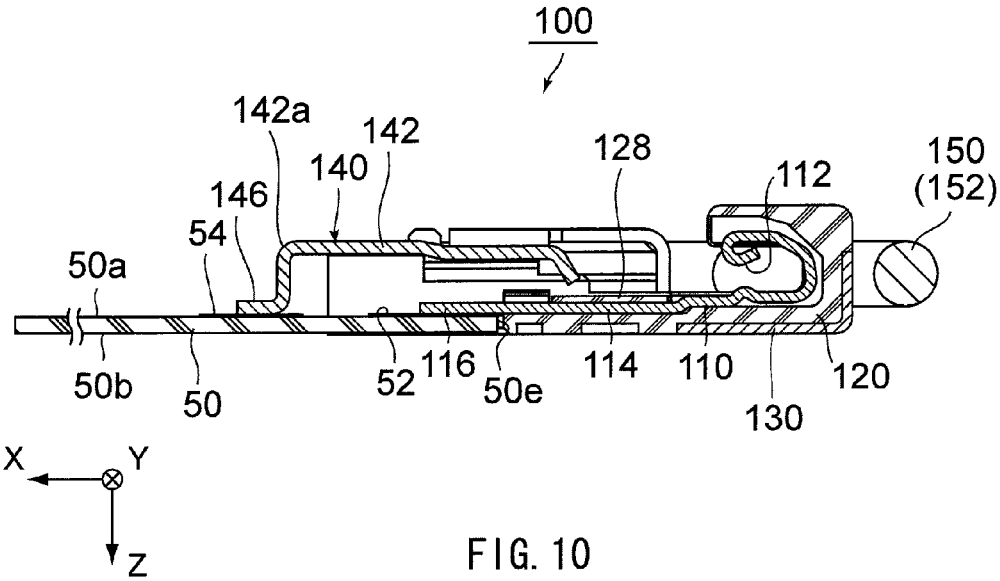
FIG. 10 is a cross-sectional view showing the connector of FIG. 8, taken along lines X-X.

As shown in FIGS. 7 and 10, the FPC 50 (i.e. the connecting object 50 of the connector 100) has a sheet-like shape. In detail, the FPC 50 comprises two principal surfaces 50*a* and 50*b*, a signal terminal 52 and a ground terminal 54. According to the present embodiment, the FPC 50 has a plurality of the signal terminals 52 arranged in the pitch direction and a plurality of the ground terminals 54 arranged in the pitch direction. The signal terminals 52 and the ground terminals 54 are arranged on the principal surface 50*a* so as to be exposed thereon (i.e. so as to be exposed on one of the principal surfaces 50*a* and 50*b*). The FPC 50 has a front edge 50*e*. Each of the signal terminals 52 extends from the front edge 50*e* of the FPC 50 along the positive X-direction. As compared with the signal terminal 52, the ground terminal 54 is located to be apart from the front edge 50*e* in the X-direction. In other words, a distance in the front-to-rear direction (X-direction) between the front edge 50*e* of the FPC 50 and the signal terminal 52 is shorter than a distance in the front-to-rear direction (X-direction) between the front edge 50*e* of the FPC 50 and the ground terminal 54. The FPC 50 further comprises two positioned portions 56 formed on opposite ends thereof in the pitch direction, respectively. The positioned portions 56 are located in the vicinity of the front edge 50*e* of the FPC 50. Each of the positioned portions 56 is formed with a projection and a depression so that the connector 100 straddles the projections of the positioned portions 56 (i.e. straddles the front edge 50*e* of the FPC 50) in the front-to rear direction when the connector 100 is attached to the FPC 50. However, only the projection or only the depression may be function as the positioned portion 56. In other words, the positioned portion 56 may be formed with a projection and/or a depression.

Figure 12:
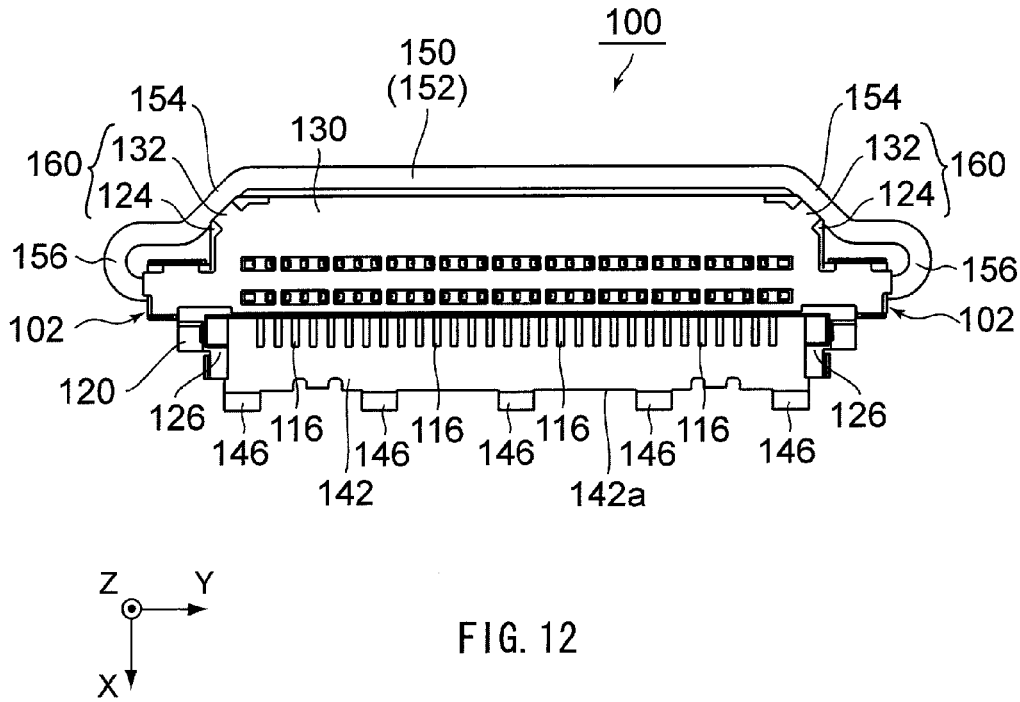
FIG. 12 is a top view showing the connector of FIG. 11 without the FPC.
Figure 13:
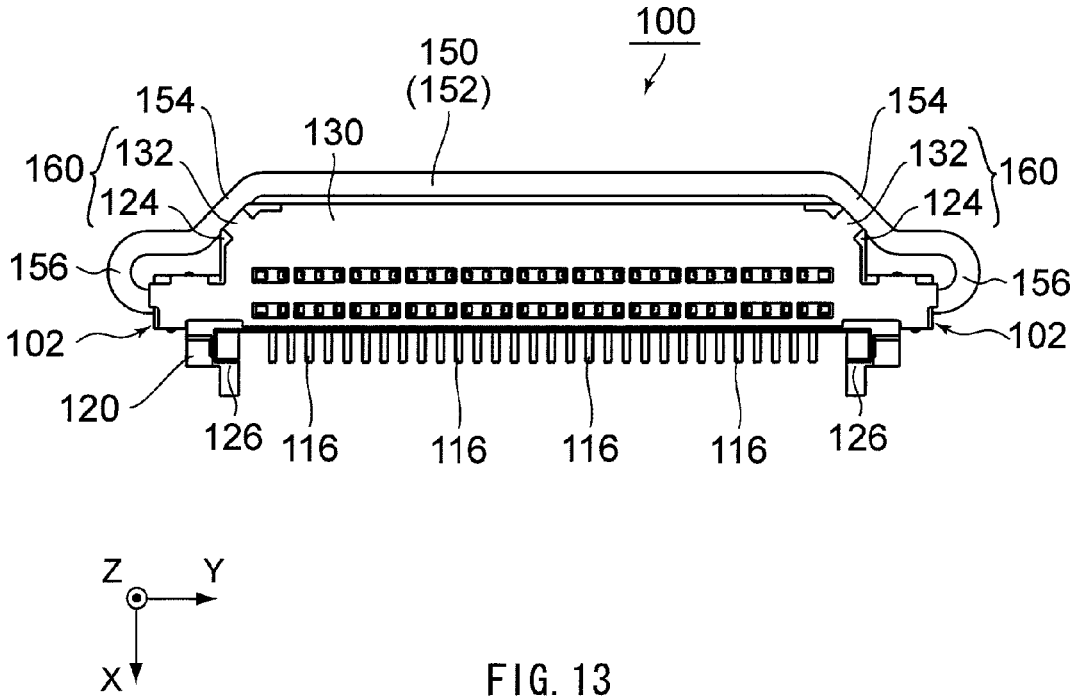
FIG. 13 is a top view showing the connector of FIG. 11 without the FPC and the cover shell.
Figure 14:
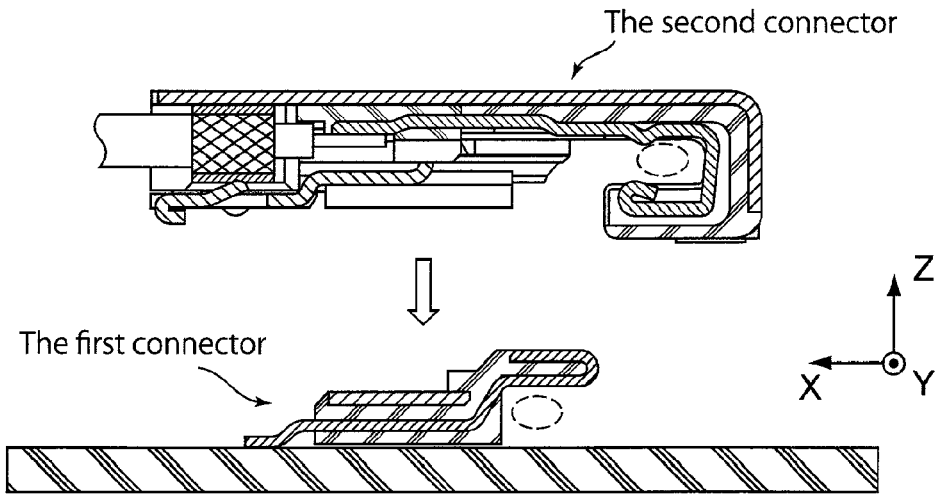
FIG. 14 is a cross-sectional view showing a structure of an existing connector assembly having a first connector and a second connector which are configured to be mated with each other by operations illustrated in FIGS. 14(*a*) to 14(*c*).
Figure 14:
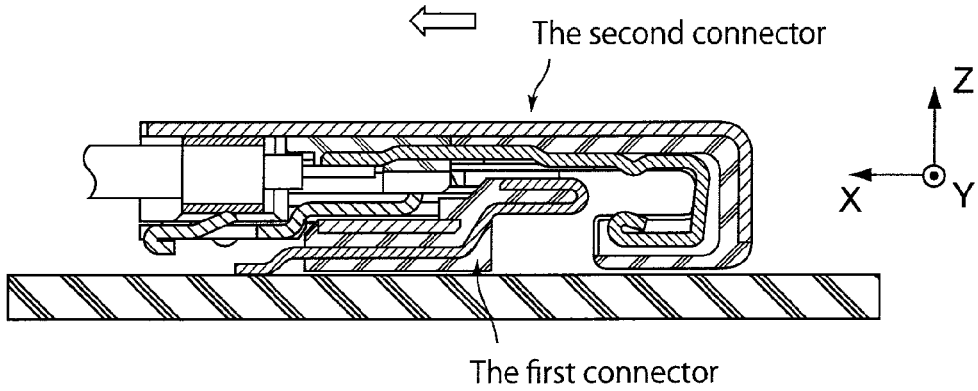
Figure 14:
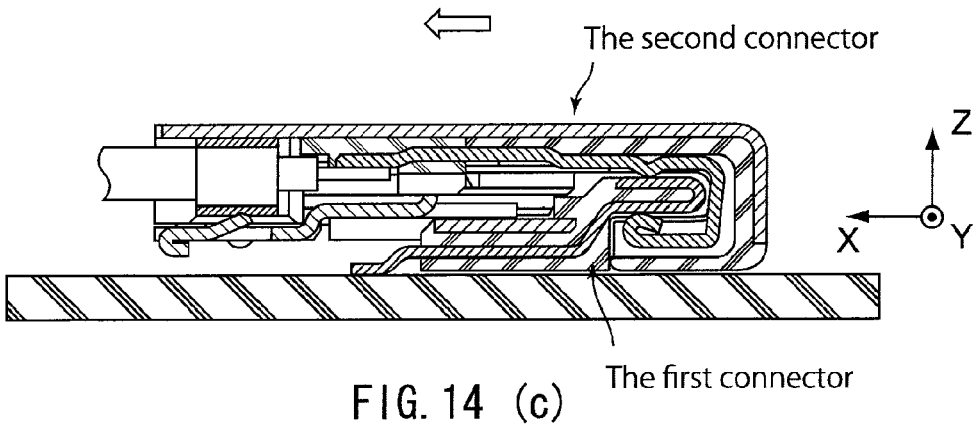

As shown in FIGS. 10 and 12, each of the contacts 110 has a contact portion 112, a held portion 114 and an exposed portion 116. The contact portion 112 has a J-like shape as seen along the Y-direction. The contact portion 112 is configured to be connected to the mating contact 210 when the connector 100 and the mating connector 200 are mated with each other. The held portion 114 is held by the housing 120. The exposed portion 116 projects from the housing 120 in the positive X-direction. The exposed portion 116 is arranged so as to be connectable to the signal terminal 52 of the FPC 50. More specifically, the exposed portion 116 has a connected surface and a back surface in the Z-direction. Furthermore, the exposed portion 116 has opposite side surfaces in the pitch direction (Y-direction). The connected surface is the positive Z-side surface of the exposed portion 116 (i.e. lower side surface of the exposed portion 116 illustrated in FIG. 10) while the back surface is the negative Z-side surface of the exposed portion 116 (i.e. upper side surface of the exposed portion 116 illustrated in FIG. 10). In other words, the back surface is opposite to the connected surface in the Z-direction. The connected surface of the exposed portion 116 is configured to be connected to the signal terminal 52 of the FPC 50 so that the connected surface is exposed. According to the present embodiment, the back surface and the side surfaces of the exposed portion 116 are also exposed. The four surfaces of the exposed portion 116 are exposed so that it is easy to form a solder fillet when the signal terminal 52 and the exposed portion 116 are reflow-soldered to be connected to each other. According to the present embodiment, it is possible to connect the signal terminal 52 and the exposed portion 116 more securely by solder joint. However, the back surface of the exposed portion 116 may not be exposed. For example, the back surface of the exposed portion 116 may be covered by a resin from which the housing 120 is formed.

As shown in FIGS. 9 to 12, the housing 120 includes two support portions 122, two eaves portions 124, two positioning portions 126 and a holding portion 128. The two support portions 122 are formed on opposite ends of the housing 120 in the pitch direction, respectively. Each of the support portions 122 is a groove extending inward in the pitch direction while being depressed in the positive Z-direction. The support portions 122 support the lock bar 150 so that the lock bar 150 is turnable. The eaves portions 124 are located in the vicinity of the negative X-side end of the housing 120. In other words, the eaves portions 124 are formed so as to be away from the FPC 50 in the X-direction. Each of the eaves portions 124 protrudes above the housing 120 so as to partially cover the housing 120. The base shell 130 is formed with two strengthen portions 132 corresponding to the eaves portions 124, respectively. Each of the eaves portions 124 is strengthened by the strengthen portion 132. The eaves portion 124 and the strengthen portion 132 function as a retaining portion 160 which is configured to lock the lock bar 150. The positioning portion 126 is configured to two-dimensionally positions the positioned portion 56 in the XY-plane. Each of the positioning portions 126 according to the present embodiment is formed with a hole and a projection which correspond to the projection and the depression of the positioned portion 56, respectively, so that the positioning portions 126 correspond to the respective positioned portions 56 of the FPC 50. However, the positioning portion 126 may be formed with a hole and/or a projection. The hole of the positioning portion 126 is a depression depressed both in the negative Z-direction and outward in the pitch direction. The projection of the positioning portion 126 projects in the positive Z-direction. When the projection and the depression of the positioned portion 56 are positioned to the hole and the projection of the positioning portion 126, respectively, the FPC 50 is two-dimensionally positioned properly in the XY-plane (i.e. the signal terminals 52 and the ground terminals 54 are positioned properly in the XY-plane). The positioning portions 126 of the housing 120 are located between the two mated portions 102 in the pitch direction. The holding portion 128 holds the held portions 114 of the contacts 110.

As shown in FIGS. 6 to 10, The cover shell 140 has a board-like portion 142, two cover portions 144 and a plurality of grounded portions 146. The board-like portion 142 extends long in the pitch direction. The board-like portion 142 has an end 142*a* in the X-direction (i.e. has a positive X-side end). As can be seen from FIGS. 1, 2, 4 and 6, the board-like portion 142 is configured to be connected to the spring portions 240 of the mating shell 230 under a mating state where the connector 100 is mated with the mating connector 200. The contact point 242 is pressed against the board-like portion 142 by an elastic force of the spring portion 240 under the mating state so that it is possible to electrically connect the cover shell 140 with the mating shell 230 (i.e. ground the cover shell 140 through the mating shell 230) more securely. As shown in FIGS. 10 and 12, the board-like portion 142 is arranged so as to be overlapped with the exposed portion 116 as seen along the negative Z-direction. In detail, as shown in FIG. 10, the board-like portion 142 is apart from the exposed portion 116 in the Z-direction. Moreover, as shown in FIGS. 10 and 12, the end 142*a* of the board-like portion 142 protrudes in the positive X-direction over the exposed portion 116. As can be seen from FIG. 10, when the connector 100 is attached to the FPC 50, a distance in the X-direction between the end 142*a* of the board-like portion 142 and the front edge 50*e* of the FPC 50 is longer than a distance in the X-direction between a tip of the exposed portion 116 and the front edge 50*e* of the FPC 50. The two cover portions 144 are located on opposite ends of the board-like portion 142 in the pitch direction, respectively. Each of the cover portions 144 extends outward in the pitch direction from the board-like portion 142. As can be seen from FIGS. 8 and 9, the cover portion 144 covers the support portion 122 of the housing 120. The board-like portion 142 according to the present embodiment is connected to the spring portion 240 of the mating connector 200 under the mating state. Therefore, it is necessary that the board-like portion 142 has a shape which is surely connectable to the spring portion 240 of the mating connector 200. In other words, it is difficult to make a large hole (i.e. an opening) on the board-like portion 142 according to the present embodiment. However, in a case where the mating shell 230 and the cover shell 140 are configured to be connected with each other without the spring portion 240, the board-like portion 142 may be formed with an opening which extends in the pitch direction. In this case, it is possible to inspect through the opening whether the signal terminals 52 of the FPC 50 are connected to the respective exposed portions 116 or not.

Figure 6:
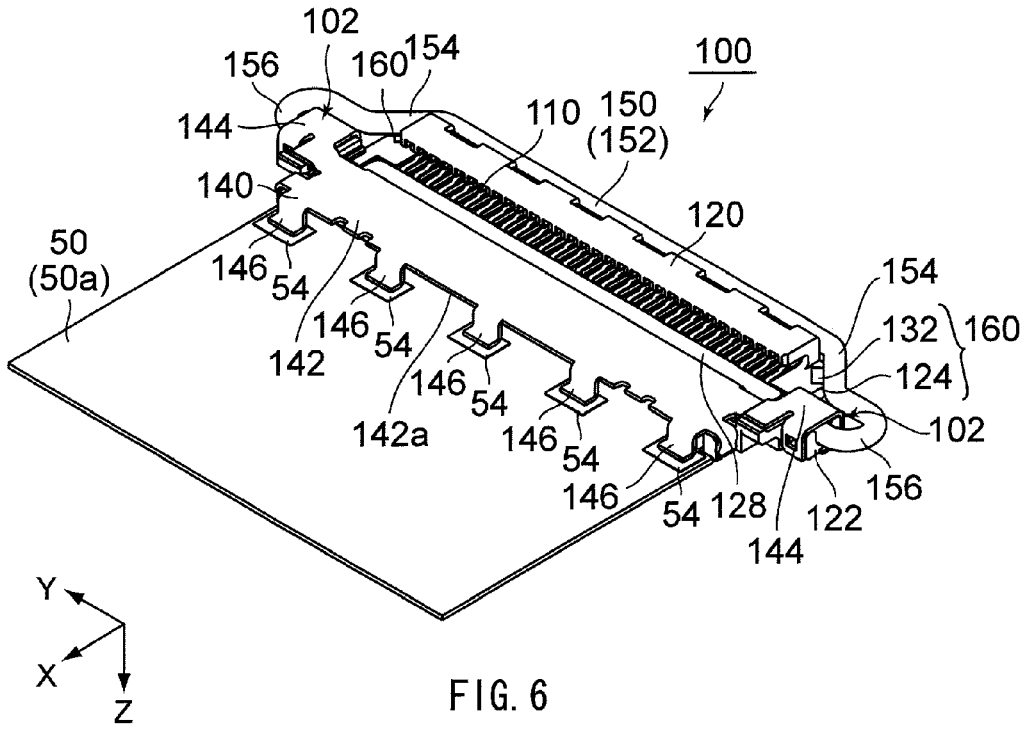
FIG. 6 is a perspective view showing a bottom side of the connector of FIG. 4, wherein the connector is attached to an FPC.
Figure 8:
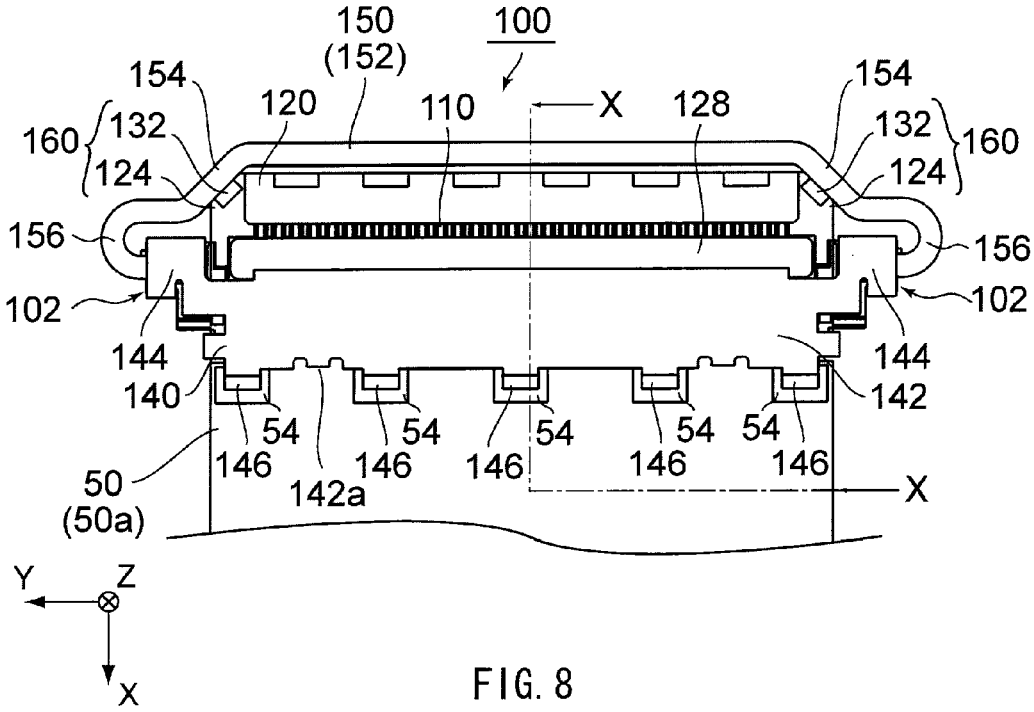
FIG. 8 is a bottom view showing the connector of FIG. 4.

As shown in FIGS. 6 to 8, each of the grounded portions 146 extends from the end 142*a* of the board-like portion 142 in the positive Z-direction. The grounded portion 146 is arranged so as to be connectable to the ground terminal 54 of the FPC 50. The number of the grounded portions 146 is equal to the number of the ground terminals 54. The grounded portions 146 are connected to the respective ground terminals 54 when the connector 100 is attached to the FPC 50. In other words, the connector 100 has a plurality of connecting points which is connected to the respective ground terminals 54. Therefore, a grounding performance of the connector 100 is improved. Moreover, when the connector 100 is attached to the FPC 50 (i.e. when the grounded portions 146 are fixed to the ground terminals 54), the cover shell 140 is attached to and held by the housing 120 more securely. As shown in FIG. 10, each of the grounded portions 146 has an L-like shape in a plane defined by the front-to-rear direction and the first vertical direction (i.e. in the XZ-plane). In detail, the grounded portion 146 extends in the positive X-direction (i.e. extends so as to be apart from the exposed portion 116) after extending from the end 142*a* of the board-like portion 142 in the first vertical direction (positive Z-direction). As shown in FIG. 10, the exposed portion 116 is located between the held portion 114 and the grounded portion 146 in the X-direction. Moreover, the grounded portion 146 and the exposed portion 116 are located at a same level (i.e. located at a predetermined position) in the first vertical direction (positive Z-direction). More specifically, in the top-to-bottom direction in FIG. 10 (i.e. in the Z-direction), a lower surface of the grounded portion 146 and a lower surface of the exposed portion 116 are arranged at a substantially same position so as to be connectable to the ground terminal 54 and the signal terminal 52 of the FPC 50, respectively. In other words, the grounded portions 146 and the exposed portions 116 define an imaginary plane on which the FPC 50 is mountable. This imaginary plane is perpendicular to the Z-direction.

As can be seen from FIGS. 7 to 10, the arrangement of the grounded portions 146 and the exposed portions 116 corresponds to the arrangement of the ground terminals 54 and the signal terminals 52 on the principal surface 50*a* of the FPC 50. As shown in FIG. 12, the exposed portions 116 and the grounded portions 146 are visible as seen along the second vertical direction (negative Z-direction). In other words, the positive Z-sides (i.e. the side on which the FPC 50 is placed) of the exposed portion 116 and the grounded portion 146 are exposed. Therefore, when the connector 100 is attached to the FPC 50, it is possible to simultaneously position the grounded portion 146 and the exposed portion 116 on the ground terminal 54 and the signal terminal 52, respectively. In other words, the connector 100 and the FPC 50 are electrically connected with each other when the connector 100 is simply placed on the principal surface 50*a* of the FPC 50 properly. Moreover, it is possible to perform a reflow process when the connector 100 is placed on the principal surface 50*a*. Therefore, according to the present embodiment, the connector 100 is more easily connected and fixed to the FPC 50. The connector 100 according to the present embodiment is provided with the positioning portions 126 corresponding to the respective positioned portions 56 of the FPC 50. The positioning portion 126 is configured so that, when the connector 100 is attached to the FPC 50, the positioning portion 126 positions the exposed portion 116 and the grounded portion 146 on a predetermined plane on which the signal terminal 52 and the ground terminal 54 are placed. Therefore, it is possible to place the connector 100 on the principal surface 50*a* of the FPC 50 properly by a simple operation. In other words, the grounded portion 146 and the exposed portion 116 are positioned easily on the ground terminal 54 and the signal terminal 52, respectively. In detail, the connector 100 is mounted on the FPC 50 so as to straddle the front edge 50*e* of the FPC 50 in the front-to-rear direction (X-direction). Then, positions of the positioned portions 56 are adjusted to positions of the respective positioning portions 126 so that the grounded portion 146 and the exposed portion 116 are positioned on the ground terminal 54 and the signal terminal 52, respectively.

Figure 9:
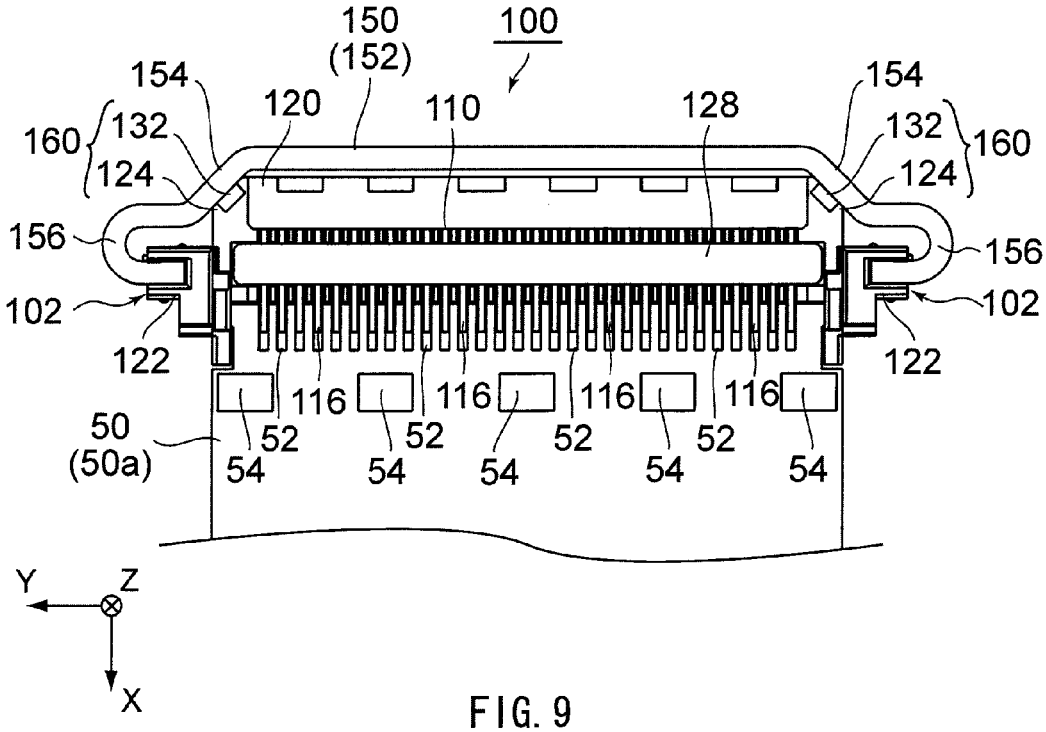
FIG. 9 is a bottom view showing the connector of FIG. 8 without a cover shell of the connector.

As shown in FIGS. 8 and 1, the lock bar 150 has a body portion 152, two retained portions 154 and two U-like portions 156. The body portion 152 extends in the pitch direction. The two retained portions 154 are formed on opposite ends of the body portion 152 in the pitch direction. Each of the retained portions 154 extends obliquely from the end of the body portion 152. In detail, each of the retained portions 154 extends outward in the pitch direction while extending in the X-direction. The two U-like portions 156 further extend from the respective retained portions 154. More specifically, each of the U-like portions 156 extends inward in the pitch direction after extending outward in the pitch direction so as to have a U-like shape. As shown in FIG. 9, the lock bar 150 is supported by the housing 120 and/or the cover shell 140 so as to be turnable. In detail, end of each of the U-like portions 156 of the lock bar 150 according to the present embodiment is supported by the support portion 122 so that the lock bar 150 is turnable. It is possible to turn the lock bar 150 between a release position (see FIG. 5) and a lock position (see FIG. 1). When the lock bar 150 is located at the release position, the connector 100 attached to the FPC 50 is matable with and connectable to the mating connector 200. The lock bar 150 is configured to lock the mating state where the connector 100 is mated with the mating connector 200. More specifically, the lock bar 150 locks the mating state of the connector 100 with the mating connector 200 when the lock bar 150 is turned over from the release position to the lock position so as to be away from the FPC 50.

Figure 11:
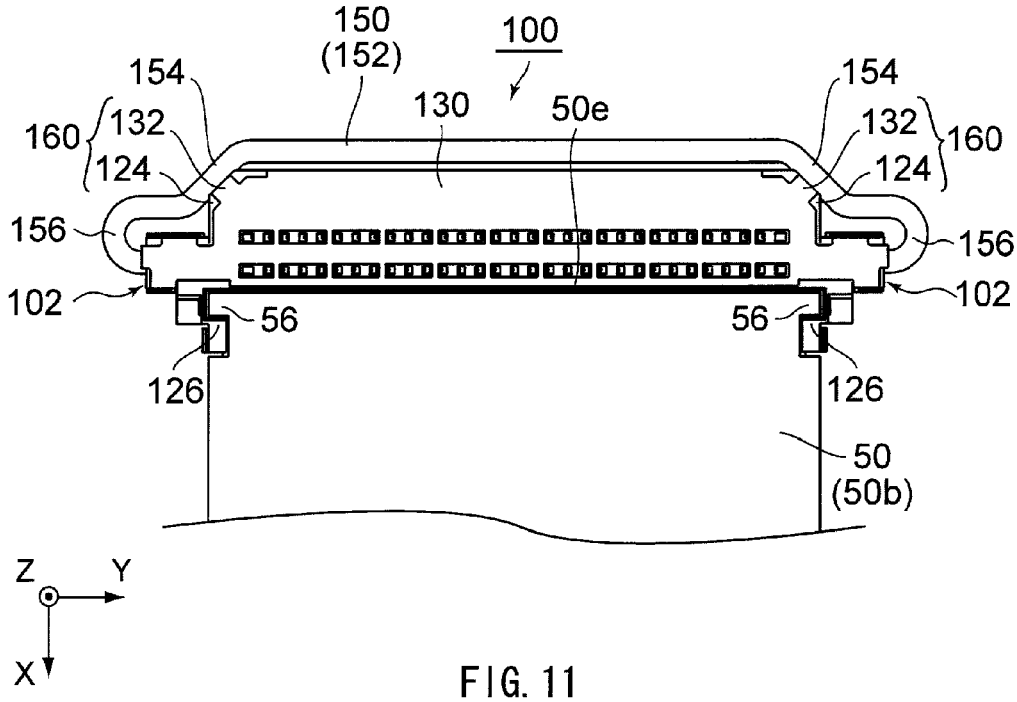
FIG. 11 is a top view showing the connector of FIG. 4.

As can be seen from FIGS. 8 and 1, the body portion 152 and the U-like portion 156 are not interfered by the connector 100 or the mating connector 200 while the lock bar 150 is turned. On the other hand, the retained portion 154 is configured so as to be interfered by the retaining portion 160 of the housing 120 while the lock bar 150 is turned. As shown in FIG. 8, when seen along the positive Z-direction, the retained portion 154 of the lock bar 150 is located in front of the retaining portion 160. On the other hand, as shown in FIG. 11, when seen along the negative Z-direction, the retaining portion 160 is located in front of the retained portion 154 of the lock bar 150. In other words, the retained portion 154 in FIG. 8 covers the retaining portion 160 while the retaining portion 160 in FIG. 11 covers the retained portion 154. As can be seen from the above description, the retained portion 154 is configured so that the retained portion 154 rides over the retaining portion 160 to be located under the retaining portion 160 (i.e. located at the negative Z-side of the retaining portion 160) while the lock bar 150 is turned from the release position to the lock position.

When the lock bar 150 is moved to lock position, the lock bar 150 is turned so as to be apart from the FPC 50. Therefore, the FPC 50 does not obstruct the turn of the lock bar 150. According to the present embodiment, even when the connector 100 having the lock bar 150 is attached to the FPC 50, the connector assembly 10 remains having a reduced height. While the lock bar 150 is turned, the U-like portion 156 is received in the mating portion 202 of the mating connector 200. The U-like portion 156 is pressed against the pressing portion 204 so that the U-like portion 156 receives a reaction force along the positive X-direction from the pressing portion 204. The connector 100 is moved along the positive X-direction by this reaction force. According to the present embodiment, the turn of the lock bar 150 horizontally moves the connector 100 in the positive X-direction after the connector 100 is positioned in the Z-direction. Therefore, it is possible to lock the mating state of the connector 100 at a same time when the connector 100 is mated with and connected to the mating connector 200.

Moreover, according to the present embodiment, the connector 100 is attachable to the FPC 50 in a state where the connector 100 is covered by the cover shell 140. In other words, it is unnecessary to attach components to the connector 100 after the connector 100 is electrically connected to the FPC 50. According to the present embodiment, it is possible to cut down a manufacturing process after the connection of the connector 100 to the FPC 50.

The present invention is applicable to a connector which is matable with a mating connector and attachable to a sheet-like connecting object, for example, an FPC or an FFC.

The present application is based on a Japanese patent application of JP2011-72910 filed before the Japan Patent Office on Mar. 29, 2011, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector configured to be mated with and connected to a mating connector in a state where the connector is attached to a connecting object of a sheet-like shape, the connecting object having a principal surface and being provided with a signal terminal and a ground terminal arranged thereon, the connector comprising:

a housing;

a plurality of contacts held by the housing so as to be arranged in a pitch direction, each of the contacts having a held portion and an exposed portion, the held portion being held by the housing, the exposed portion being arranged so as to be connectable to the signal terminal of the connecting object, the exposed portion projecting from the housing in a front-to-rear direction perpendicular to the pitch direction, the exposed portion being located at a predetermined position in a first vertical direction perpendicular to the pitch direction;

a cover shell covering at least a part of the housing in the first vertical direction, the cover shell having a grounded portion, the grounded portion being arranged so as to be connectable to the ground terminal of the connecting object, the grounded portion being located at the predetermined position in the first vertical direction; and a lock bar supported by at least one of the housing and the cover shell so as to be turnable, the lock bar being configured to lock a mating state where the connector is mated with the mating connector.

2. The connector as recited in claim 1, wherein the exposed portion and the grounded portion are visible as seen along a second vertical direction opposite the first vertical direction.

3. The connector as recited in claim 2, wherein:

the connecting object has a front edge;

a distance in the front-to rear direction between the front edge of the connecting object and the signal terminal is shorter than a distance in the front-to rear direction between the front edge of the connecting object and the ground terminal; and the connector straddles the front edge of the connecting object in the front-to rear direction when the connector is attached to the connecting object.

4. The connector as recited in claim 3, wherein the cover shell has a board-like portion, the board-like portion being arranged so as to be overlapped with the exposed portion as seen along the second vertical direction, the board-like portion being apart from the exposed portion in the second vertical direction.

5. The connector as recited in claim 4, wherein:

the board-like portion has an end in the front-to-rear direction; and the grounded portion extends from the end of the board-like portion in the first vertical direction.

6. The connector as recited in claim 5, wherein the grounded portion has an L-like shape in a plane defined by the front-to-rear direction and the first vertical direction.

7. The connector as recited in claim 1, wherein the lock bar locks the mating state of the connector with the mating connector when the lock bar is turned over so as to be away from the connecting object.

8. The connector as recited in claim 1, further comprising a positioning portion, wherein the positioning portion is configured so that, when the connector is attached to the connecting object, the positioning portion positions the exposed portion and the grounded portion on a predetermined plane on which the signal terminal and the ground terminal are placed.

9. The connector as recited in claim 8, the connector being configured to be attached to the connecting object which has two positioned portions formed on opposite ends thereof in the pitch direction, respectively, each of the positioned portions being formed with at least one of a projection and a depression, wherein the housing is formed with two of the positioning portions, each of the positioning portions being formed with at least one of a hole and a projection so that the positioning portions correspond to the respective positioned portions.

10. The connector as recited in claim 9, the connector being configured to be mated with the mating connector having two mating portions, the connector further comprising two mated portions, wherein:

the mated portions are formed on opposite ends of the connector in the pitch direction, the mated portions being configured to be mated with the respective mating portions of the mating connector; and the positioning portions of the housing are located between the two mated portions in the pitch direction.

11. The connector as recited in claim 1, wherein the exposed portion has opposite side surfaces in the pitch direction, the side surfaces being exposed.

12. The connector as recited in claim 11, wherein the exposed portion has a connected surface configured to be connected to the connecting object and a back surface opposite to the connected surface, the back surface being exposed.

13. The connector as recited in claim 1, wherein the exposed portion is located between the held portion and the grounded portion in the front-to-rear direction.

14. The connector as recited in claim 1, wherein the connector is moved in the front-to-rear direction toward the mating connector after the connector and the mating connector are positioned in the first vertical direction so that the connector is mated with and connected to the mating connector.

* * * * *

UNITED STATES PATENT AND TRADEMARK OFFICE

CERTIFICATE OF CORRECTION

PATENT NO. : 8,550,849 B2
APPLICATION NO. : 13/432879
DATED : October 8, 2013
INVENTOR(S) : Takahiro Yamaji It is certified that error appears in the above-identified patent and that said Letters Patent is hereby corrected as shown below:

On the Title page; under OTHER PUBLICATIONS, line 1:

delete “Offrice” and insert --Office--.

In the Specification;

Column 7, line 46:

delete “1,” and insert --11,--.

Column 8, line 7:

delete “1,” and insert --11,--.

Signed and Sealed this
Sixth Day of May, 2014

Michelle K. Lee

Michelle K. Lee
*Deputy Director of the United States Patent and Trademark Office*